US005332712A

United States Patent [19]

Shinohara et al.

[11] Patent Number: 5,332,712

[45] Date of Patent: Jul. 26, 1994

[54] IMAGE RECEIVING SHEET FOR THERMAL TRANSFER RECORDING

[75] Inventors: Hideo Shinohara, Yokohama; Yukichi Murata, Sagamihara; Tsutomu Taki, Tokyo, all of Japan

[73] Assignee: Mitsubishi Kasei Corporation, Tokyo, Japan

[21] Appl. No.: 17,000

[22] Filed: Feb. 12, 1993

Related U.S. Application Data

[63] Continuation of Ser. No. 649,043, Feb. 1, 1991, Pat. No. 5,187,144.

[30] Foreign Application Priority Data

Feb. 2, 1990 [JP] Japan ..... 2-24222
Aug. 23, 1990 [JP] Japan ..... 2-222176
Aug. 23, 1990 [JP] Japan ..... 2-222177

[51] Int. Cl.[5] ..... B41M 5/035; B41M 5/38

[52] U.S. Cl. ..... 503/227; 428/195; 428/413; 428/423.1; 428/447; 428/474.4; 428/480; 428/500; 428/520; 428/522; 428/913; 428/914

[58] Field of Search ..... 8/471; 428/195, 413, 428/423.1, 447, 480, 500, 520, 913, 914, 474.4, 522; 503/227

[56] References Cited

U.S. PATENT DOCUMENTS 4,720,480 1/1988 Ito et al. ..... 503/227
4,985,397 1/1991 Uemura et al. .
5,187,144 2/1993 Shinohara et al. ..... 503/227

FOREIGN PATENT DOCUMENTS

.0349141 1/1990 European Pat. Off. .
63-19295 1/1988 Japan .

*Primary Examiner*—B. Hamilton Hess
*Attorney, Agent, or Firm*—Oblon, Spivak, McClelland, Maier & Neustadt

[57] ABSTRACT

An image receiving sheet for thermal transfer recording is described. The sheet contains a substrate and an image receiving layer formed thereon for receiving a sublimable dye. The image receiving layer contains, as its main component, a product formed by thermosetting a composition of an active hydrogen-containing resin, a modified silicone resin, a silicone oil and a polyfunctional isocyanate compound.

15 Claims, No Drawings

IMAGE RECEIVING SHEET FOR THERMAL TRANSFER RECORDING

This is a continuation of application Ser. No. 07/649,043, filed on Feb. 1, 1991, U.S. Pat. No. 5,187,144.

The present invention relates to an image receiving sheet for thermal transfer recording.

In recent years, as a method for obtaining a color hard copy, a thermal transfer recording method has rapidly become popular because of its simplicity and easy maintenance and low costs of the apparatus. Particularly, an attention has been drawn to a dye transfer system, since it is thereby possible to obtain a highly fine color hard copy similar to a photograph. According to this system, recording is conducted by heating a transfer recording sheet having an ink layer composed mainly of a heat transferable dye and a binder resin on one side of a base film, from its rear side by a heating means such as a thermal head, to transfer the dye to an image receiving sheet having an image receiving layer composed mainly of a dyable resin on the surface of a substrate. The image receiving sheet is required to have the following properties:

1) At the time of transfer recording, it does not fuse or stick to the transfer recording sheet, and after the recording, the transfer recording sheet can readily be peeled therefrom.

2) The tinting strength of the dye to the image receiving layer is excellent, and it is thereby possible to obtain a record of high density and high gradient.

3) The storage stability such as resistance against blotting of the colorant of the record, resistance against discoloration by light, fade resistance, solvent resistance and finger print resistance, is excellent.

In order to satisfy the above requirements for an image receiving sheet for transfer recording, various proposals have been made for the resin for forming the image receiving layer and various additives such as a releasing agent, a sensitizer and a photostabilizer.

Further, high speed has recently been desired for printing, and it has been common to increase the speed by applying a high energy to the thermal head for a short period of time. Further, for improving the printing speed further, a study is now being made on a method wherein a conductive film is used as the substrate of the transfer recording sheet and recording electrodes are used instead of the thermal head, so that electric current is conducted in the conductive film by means of the recording electrodes to create Joul heat, whereby the thermal efficiency can be improved and the heat accumulation in the electrodes can be prevented to further improve the printing speed.

Under these circumstances, among the above three requirements, item (1) has become particularly important, i.e. it is important how to conduct releasing of the transfer recording sheet smoothly without creating fusion.

Even if fusion does not take place, there still remains a problem that due to the high temperature, the surface of the image receiving layer undergoes thermal deformation, whereby gloss tends to be lost especially at a black portion where printing is repeated three times with yellow, magenta and cyan, and the image quality tends to be poor.

As methods for solving such problems, it has been proposed to use for the image receiving layer a cross-linked product of a polyurethane polyol with a polyisocyanate (Japanese Unexamined Patent Publication No. 132387/1986), a cross-linked product of a polyester resin with a curing agent such as isocyanate, epoxy, melamine or phenol (Japanese Unexamined Patent Publication No. 25089/1987) or a product obtained by thermosetting a composition comprising a thermosetting resin having polar groups, a curing agent and a modified silicone oil as the main components (Japanese Unexamined Patent Publication No. 19295/1988).

However, when the above-mentioned cross-linked products are used for image receiving layers, the surface of the image receiving layers tends to be hard, whereby although the fusion or thermal deformation scarcely takes place, the tinting properties with a dye tends to be poor because of the hard surface, and consequently there will be a problem that the image density tends to be low. In order to improve the image density, the amount of the cross-linking agent has to be reduced, whereby there will be a problem that fusion or thermal deformation is likely to take place. Thus, it has been impossible to solve both problems at the same time.. Further, mere use of a cross-linked product for the image receiving layer, is inadequate for providing fusion-preventing effects. Especially when printing is conducted by the current conducting system using the conductive sheet and electrodes, a high energy is exerted, whereby fusion is likely to take place. Further, when the above polyurethane resin or polyester resin is used, light resistance is poor, and the storage stability is inadequate.

Under these circumstances, the present inventors have conducted extensive studies, and as a result, have found that when a certain specific component, particularly a silicone resin, is incorporated to an image receiving layer having a cross-linked structure formed by cross-linking with an isocyanate, the respective effects complement the drawbacks of the other, whereby it is possible to obtain an image receiving sheet for thermal transfer recording having excellent synergistic effects. The present invention has been accomplished on the basis of this discovery.

Namely, an object of the present invention is to provide an image receiving sheet for thermal transfer recording which is free from fusion to the transfer recording sheet and can readily be peeled therefrom, of which the surface of the image receiving layer after printing has little thermal deformation and which provides a high image density. Further, it is another object of the present invention to provide an image receiving sheet for thermal transfer recording which also has various excellent storage properties such as light resistance, fade resistance, bleeding resistance, solvent resistance and finger print resistance.

Such objects of the present invention can be readily accomplished by an image receiving sheet for thermal transfer recording, which comprises a substrate and an image receiving layer formed thereon for receiving a sublimable dye, wherein the image receiving layer comprises, as the main component, a product formed by thermosetting a composition comprising an active hydrogen-containing resin, a silicone resin, a silicone oil and a polyfunctional isocyanate compound.

The reason why the image receiving sheet of the present invention has such excellent properties is not clearly understood. However, it may be pointed out as a reason that the silicone resin has a high ability of permitting a dye to permeate and at the same time takes a structure which is capable of loosening the cross-linked structure of the resin due to the polyfunctional isocyanate compound to some extent, whereby while it has heat resistance, the tinting properties with the dye are excellent and the image density is high.

Now, the present invention will be described in detail with reference to the preferred embodiments.

As the substrate for the image receiving sheet to be used in the present invention, various papers made of cellulose fibers, various synthetic papers and plastic films prepared from synthetic resins and composite materials of such substrates, may be mentioned.

In the present invention, the image receiving layer comprises, as the main component, a product formed by thermosetting a composition comprising four components of an active hydrogen-containing resin, a silicone resin, a silicone oil and a polyfunctional isocyanate.

The active hydrogen-containing resin includes resins having hydrogen atoms readily reactive with isocyanate groups, such as a saturated polyester resin, a polyamide resin, an acryl resin, a cellulose acetate resin, a phenoxy resin, a polyurethane resin, an epoxy resin, a vinyl chloride-vinyl acetate-vinyl alcohol copolymer resin and a polyvinyl acetal resin. Among them, polyacetal resin or a polyvinyl chloride resin is preferred. Further, it is particularly preferred to employ a polyvinyl acetal resin in combination with a hydrogen group-containing polyvinyl chloride resin. The glass transition temperature (Tg) of such a resin is preferably from 0° to 150° C., more preferably from 40° to 120° C. If Tg is too low, fixing of the dye tends to be poor, and fading of the image tends to result during storage for a long period of time. On the other hand, if Tg is too high, the tinting properties with the dye tends to be poor, whereby the image density tends to be low.

The polyvinyl acetal resin includes, for example, polyvinyl acetal, polyvinyl buryral, polyvinyl formal, polyvinyl benzal and polyvinylphenyl acetal. These resins can be prepared by converting polyvinyl alcohol to acetals by means of various aldehydes. These resins are usually represented by the following formula (I) and contain from 10 to 50 mol % of hydroxyl groups:

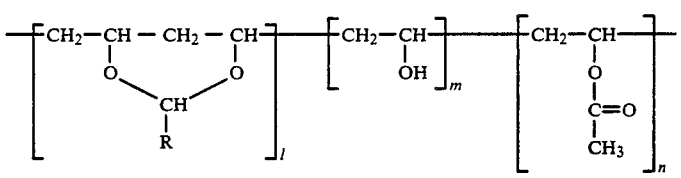

(I)

In the above formula, R is hydrogen, an alkyl group or a phenyl or benzyl group which may have substituents, and l, m and n represent the percentages of the respective structural units, and they are within the ranges of $50<l<85$, $10<m<50$ and $0<n<30$.

As the polyvinyl chloride resin, a polymer comprising vinyl chloride as the main monomer and functional groups reactive with isocyanate groups, is employed. Particularly preferred is a vinyl chloride/vinyl acetate copolymer resin obtained by copolymerizing vinyl chloride with vinyl acetate. The functional group for the polyvinyl chloride resin may be an alcoholic hydroxyl group, a carboxyl group, an amino group or an epoxy group. The alcoholic hydroxyl group may be introduced by partial hydrolysis after the copolymerization of vinyl chloride and vinyl acetate, or may be introduced by adding and copolymerizing a component having a hydroxyl group such as 2-hydroxyethyl methacrylate in addition to vinyl chloride and vinyl acetate during the polymerization. The carboxyl group may be introduced by adding and copolymerizing maleic acid during the polymerization. The amino group may be introduced by reacting a diamine to an acrylic acid moiety of the copolymer of e.g. vinyl chloride, vinyl acetate and methacrylic acid. The epoxy group may be introduced, for example, by reacting epichlorohydrin to an alcoholic hydroxyl group. These compounds may be used alone or in combination as a mixture of two or more, as the polyvinyl chloride resin having functional groups reactive with isocyanate groups.

These resins preferably comprise, for example, from 60 to 95% by weight, particularly from 80to 95% by weight, of units derived from vinyl chloride, from 0 to 39% by weight, particularly from 1 to 19% by weight, of units derived from vinyl acetate and from 1 to 40% by weight, particularly from 1 to 20% by weight, of functional group units reactive with isocyanate groups. These resins may be commercially available products. For example, as those having alcoholic hydroxyl groups, UCAR solution vinyl VAGH, VAGD, VAGF, VAGC and VROH (manufactured by Union Carbide Co., Ltd.), Denka Vinyl #1000GK, #1000GKT and #1000GSK (manufactured by Denki Kagaku Kogyo Kabushiki Kaisha) and Esrec A (manufactured by Sekisui Chemical Industries Co., Ltd.) may be mentioned. As commercial products having carboxyl groups, UCAR solution vinyl VMCH, VMCC and VMCA (manufactured by Union Carbide Co,. Ltd.), Denka Vinyl #1000C, #1000CS and #1000CK (manufactured by Denki Kagaku Kogyo Kabushiki Kaisha) and Esrec M (manufactured by Sekisui Chemical Industries Co., Ltd.) may be mentioned. Further, as commercial products having epoxy groups, UCAR solution vinyl VERR-40 (Union Carbide Co., Ltd.) may be mentioned.

In a preferred embodiment of the present invention, the active hydrogen-containing resin may be a mixture comprising a polyvinyl acetal resin and a hydroxyl group-containing polyvinyl chloride resin. In such a case, if a polyvinyl chloride resin having no hydroxyl group is employed, it will not be compatible with the polyvinyl acetal resin and will form a segregated structure, whereby solvent resistance and finger print resistance will be poor.

The blending ratio of these two types of resins is preferably such that the hydroxyl group-containing polyvinyl chloride resin is from 5 to 100 parts by weight, more preferably from 20 to 80 parts by weight, relative to 100 parts by weight of the polyvinyl acetal resin. If the hydroxyl group-containing polyvinyl chloride resin is less than 5 parts by weight, no adequate effect for improving the solvent resistance and finger print resistance will be observed. On the other hand, if it exceeds 100 parts by weight, the merits of the polyvinyl acetal resin such as light resistance and fade resistance can not be utilized, and light resistance tends to be poor.

As the silicone resin, it is possible to use modifying silicone resins having hydroxyl groups or alkoxy groups as functional groups, as well as modified silicone resins i.e. silicone resins modified by organic groups having various functional groups, such as a urethane-modified silicone resin, an epoxy-modified silicone resin, a polyester-modified silicone resin, .an alkid-modified silicone resin, an acryl-modified silicone resin, a melamine-modified silicone resin and a phenol-modified silicone resin. These silicone resins may be used as dissolved in solvents in the form of varnish. The silicone resin is preferably used in an amount of from 10 to 400 parts by weight, more preferably from 20 to 200 parts by weight, relative to 100 parts by weight of the total amount of the active hydrogen-containing resins. If the amount is less than 10 parts by weight, it tends to be difficult to sufficiently complement the deterioration of the transfer density due to the isocyanate cross-linking. On the other hand, if it exceeds 400 parts by weight, the image receiving layer tends to have tacking properties, and fusion with the ink layer tends to take place.

As the silicone oil, not only dimethyl silicone oil but also various modified silicone oils such as olefin-modified silicone oil, fluorine-modified silicone oil, polyether-modified silicone oil, alcohol-modified silicone oil, carboxy-modified silicone oil, amino-modified silicone oil, mercapto-modified silicone oil and epoxy-modified silicone oil, may be mentioned. Further, a modified silicone oil having the above-mentioned functional groups at both terminals of the molecule, can preferably be used. The silicone oil is used preferably in an amount of from 0.02 to 20 parts by weight, more preferably from 0.1 to 10 parts by weight, relative to 100 parts by weight of the total amount of the active hydrogen containing resins. If the amount is less than 0.02 parts by weight, the fusion of the image receiving layer with the ink layer tends to take place. On the other hand, if the amount exceeds 20 parts by weight, fixing of the dye tends to be poor, and fading of the image tends to result during the storage for a long period of time.

As the polyfunctional isocyanate compound, various kinds of diisocyanates, triisocyanates and polyisocyanates can be used. For example, tolylene diisocyanate, xylene diisocyanate, 4,4'-diphenylmethane diisocyanate, 1,5-naphthylene diisocyanate, 1',4-tetramethylene diisocyanate, 1,6-hexamethylene diisocyanate, isopropylidenecyclohexyl diisocyanate, isophorone diisocyanate and various derivatives thereof can be used. The amount of such a polyfunctional isocyanate compound is preferably selected so that the amount of isocyanate groups would be from 0.1 to 3 times, more preferably from 0.2 to 2 times, the amount of active hydrogen in the entire resins. Usually, the polyfunctional isocyanate compound is used in an amount of from 3 to 200 parts by weight, more preferably from 6 to 140 parts by weight, relative to 100 parts by weight of the total amount of the active hydrogen-containing resins. If the amount of isocyanate groups is less than 0.1 time the amount of the functional groups in the resins, cross-linking points tend to be small in number, and cross-linking effects tend to be inadequate, whereby fusion with the ink layer tends to take place, and the thermal deformation after printing tends to be substantial. On the other hand, if the amount exceeds 3 times, it takes time for cross-linking, whereby the image density tends to be hardly stable.

To the image receiving layer of the image receiving sheet of the present invention, other resins may be incorporated to such an extent not to impair the above described properties. For example, the image receiving layer may contain a styrene resin, a vinyl chloride resin, a polyester resin, a polyarylate resin or an AS resin. Further, to the image receiving layer, an ultraviolet absorber, a photostabilizer, an antioxidant, a fluorescent brightener, an antistatic agent, a cross-linking agent, etc. may be incorporated. The image receiving layer of the present invention may be formed by a method which comprises dissolving the above-mentioned active hydrogen-containing resin, the silicone resin, the silicone oil and the polyfunctional isocyanate compound in a suitable solvent, incorporating other resins and additives as the case requires, to obtain a coating solution, coating the solution on a substrate, followed by heating for a cross-linking reaction.

A feature of the present-invention is that the above-mentioned four components are distributed in the image receiving layer in a dispersed or molten state as uniform as possible, and is not in a state where any one of the components is locally concentrated alone e.g. present in a separated phase.

As the solvent for the preparation of the coating solution, various organic solvents may be employed which provide good solubility to the active hydrogen-containing resin, the silicone resin, the silicone oil and the polyfunctional isocyanate compound of the present invention. For example, it may be an alcohol solvent such as methanol, ethanol or propanol; an aromatic solvent such as toluene or xylene; a ketone solvent such as methyl ethyl ketone, methyl isobutyl ketone or cyclohexanone; an ester solvent such as ethyl acetate or butyl acetate; an ether solvent such as tetrahydrofuran or dioxane; or a solvent mixture thereof.

The coating method may be selected optionally from conventional methods. For example, methods using a reverse roll coater, a gravure coater, a rod coater and an air doctor coater, may be employed. The thickness of the image receiving layer to be formed on the substrate is usually from 0.1 to 20 μm, preferably from 1 to 10 μm, as the dried coating layer.

As the sublimable dye to be used for the thermal transfer recording color sheet to be used in combination with the image receiving sheet of the present invention, various nonionic sublimable dyes of e.g. azo type, anthraquinone type, nitro type, styryl type, naphthoquinone type, quinophthalone type, azomethine type, cumalin type and condensed polycyclic type, may be employed.

Now, the present invention will be described in further detail with reference to Examples and Comparative Examples. However, it should be understood that the present invention is by no means restricted to such specific Examples. In these Examples, "parts" means "parts by weight".

EXAMPLE 1

| (a) Preparation of an image receiving sheet | |
|---|---|
| Polyvinyl butyral resin (manufactured by Sekisui Chemical Industries Co., Ltd., tradename: Esrec BH-S) | 100 parts |
| Modified silicone resin (varnish) (manufactured by Toshiba Silicone K.K., tradename: TSR-160) | 50 parts |
| Alcohol-modified silicone oil | 5 parts |

-continued

| (a) Preparation of an image receiving sheet | |
|---|---|
| (manufactured by Shin-Etsu Chemical Co., Ltd., tradename: KF851) | |
| Polyfunctional isocyanate compound (manufactured by Mitsubishi Kasei Corporation, tradename: Mytec GP 750A) | 40 parts |
| Toluene | 600 parts |
| Methyl ethyl ketone | 600 parts |

A coating solution having the above composition was coated on a polypropylene synthetic paper having a thickness of 150 μm by a wire bar, followed by drying to form a coating layer having a dried layer thickness of about 5 μm. Then, heat treatment was conducted for 12 hours in an oven of 100° C. to obtain an image receiving sheet.

(b) Preparation of a Color Sheet

On a biaxially stretched polyethylene terephthalate film (thickness: 6 μm) having the rear side of the ink-coating side treated for heat resistance and lubricating properties, an ink comprising 5 parts by weight of a magenta sublimable dye of the following structure (A), 10 parts by weight of a polycarbonate resin and 85 parts by weight of toluene, was coated and dried to form an ink layer having a dried layer thickness of about 1 μm. Thus, a color sheet was prepared.

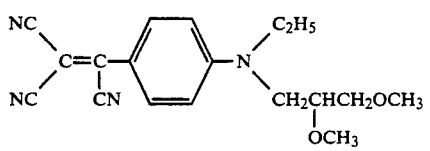

(A)

(c) Transfer Recording Test

The ink-coated side of the above color sheet was overlaid on the image receiving sheet prepared in the above step (a), and recording was conducted under the following conditions using a-thin film type line thermal head having a heat generating resister density of 8 dots/mm:

Recording line density: 8 lines/mm

Electric power applied to the thermal head: 0.6 W/dot

Width of pulses applied to the thermal head: 4 msec

The color density was as high as 1.79, and no fusion was observed between the ink layer and the image receiving layer. The printed surface was observed by a microscope, whereby no substantial trace of thermal deformation by the thermal head was observed.

Further, the above record was stored for five days at 60° C. under a relative humidity of 60%, whereupon the degree of the color blotting of the record was inspected by a microscope, whereby no substantial blotting was observed.

COMPARATIVE EXAMPLE 1

An image receiving sheet was prepared in the same manner as in Example 1 except that no modified silicone resin was used. Recording was conducted in the same manner as in Example 1, whereby the color density was as low as 1.21, although no fusion was observed between the ink layer and the image receiving layer, and no substantial trace of thermal deformation by the thermal head was observed by the microscopic inspection of the printed surface.

No substantial color blotting of the record after the storage test was observed.

COMPARATIVE EXAMPLE 2

An image receiving sheet was prepared in the same manner as in Example 1 except that no polyfunctional isocyanate compound was used. Recording was conducted in the same manner as in Example 1, whereby although the color density was as high as 1.80, slight fusion was observed between the ink layer and the image receiving layer, and a mark of thermal deformation by the thermal head was distinctly observed by the microscopic inspection of the printed surface, and the gloss of the printed portion was low.

No color blotting of the record after the storage test was observed.

EXAMPLE 2

| | |
|---|---|
| Polyvinyl benzal resin | 100 parts |
| Epoxy-modified silicone resin (varnish) (manufactured by Toshiba Silicone K.K., tradename: TSR-194) | 40 parts |
| Epoxy-modified silicone oil (manufactured by Shin-Etsu Chemical Co., Ltd., tradename: X-22-343) | 3 parts |
| Polyfunctional isocyanate compound (manufactured by Mitsubishi Kasei Corporation, tradename: Mytec NY215Y) | 30 parts |
| Toluene | 600 parts |
| Methyl ethyl ketone | 600 parts |

A coating solution having the above composition was applied in the same manner as in Example 1 to obtain an image receiving sheet.

The above polyvinyl benzal resin was obtained by converting polyvinyl alcohol (saponification degree: 98 mol %, polymerization degree: 2400) to acetal by benzaldehyde.

Recording was conducted in the same manner as in Example 1, whereby the color density was as high as 1.78, and no fusion was observed between the ink layer and the image receiving layer. Further, the printed surface was inspected by a microscope, whereby no substantial trace of thermal deformation by the thermal head was observed.

Further, no color blotting of the record after the storage test was observed.

EXAMPLE 3

| | |
|---|---|
| Polyvinyl p-methylbenzal resin | 100 parts |
| Polyester-modified silicone resin (varnish) (manufactured by Toshiba Silicone K.K., tradename: TSR-187) | 70 parts |
| Epoxypolyether-modified silicone oil (manufactured by Shin-Etsu Chemical Co., Ltd., tradename: SF-8421) | 3 parts |
| Polyfunctional isocyanat compound (manufactured by Mitsubishi Kasei Corporation, tradename: Mytec GP-105A) | 50 parts |
| Toluene | 400 parts |
| Methyl ethyl ketone | 600 parts |

A coating solution having the above composition was applied in the same manner as in Example 1 to obtain an image receiving sheet.

The above polyvinyl p-methylbenzal resin was prepared by converting polyvinyl alcohol (saponification degree: 80 mol %, polymerization degree: 2000) to acetal by p-tolualdehyde.

Recording was conducted in the same manner as in Example 1, whereby the color density was as high as 1.75, and no fusion was observed between the ink layer and the image receiving layer. Further, the printed surface was inspected by a microscope, whereby no substantial trace of thermal deformation by the thermal head was observed.

Further, no color blotting of the record after the storage test was observed.

EXAMPLE 4

| | |
|---|---|
| Acryl resin (manufactured by Mitsubishi Rayon Co., Ltd., tradename; Dianal LR 1503) | 100 parts |
| Acryl-modified silicone resin (varnish) (Toshiba Silicone K.K., tradename, TSR-170) | 100 parts |
| Amino-modified silicone oil (manufactured by Shin-Etsu Chemical Co., Ltd., tradename: KF-393) | 3 parts |
| Polyfunctional isocyanate compound (manufactured by Mitsubishi Kasei Corporation, tradename: Mytec NY-215Y) | 100 parts |
| Toluene | 600 parts |
| Methyl ethyl ketone | 600 parts |

A coating solution having the above composition was applied in the same manner as in Example 1 to obtain an image receiving sheet.

Recording was conducted in the same manner as in Example 1, whereby the color density was as high as 1.72, and no fusion was observed between the ink layer and the image receiving layer. Further, the printed surface was inspected by a microscope, whereby no substantial trace of thermal deformation by the thermal head was observed.

Further, no color blotting of the record after the storage test was observed.

EXAMPLE 5

| | |
|---|---|
| Saturated polyester resin (manufactured by Toyobo Co., Ltd., tradename, Viron GK-130 | 100 parts |
| Alkid-modified silicone resin (varnish) (Toshiba Silicone K.K., tradename: TSR-184) | 60 parts |
| Carboxy-modified silicone oil (manufactured by Shin-Etsu Chemical Co., Ltd., tradename: X-22-3715) | 3 parts |
| Polyfunctional isocyanate compound (manufactured by Mitsubishi Kasei Corporation, tradename: Mytec NY-215Y) | 80 parts |
| Toluene | 600 parts |
| Methyl ethyl ketone | 600 parts |

A coating solution having the above composition was applied in the same manner as in Example 1 to obtain an image receiving sheet.

Recording was conducted in the same manner as in Example 1, whereby the color density was as high as 1.78, and no fusion was observed between the ink layer and the image receiving layer. Further, the printed surface was inspected by a microscope, whereby no substantial trace of thermal deformation by the thermal head was observed.

Further, no color blotting of the record after the storage test was observed.

EXAMPLE 6

| | |
|---|---|
| Vinyl chloride-vinyl acetate-vinyl alcohol copolymer resin (manufactured by Sekisui Chemical Co., Ltd., tradename: Esrec A) | 100 parts |
| Modified silicone resin (varnish) (manufactured by Toshiba Silicone K.K., tradename: TSR-165) | 30 parts |
| Mercapto-modified silicone oil (manufactured by Shin-Etsu Chemical Co., Ltd., tradename; X 22-980) | 1 part |
| Polyfunctional isocyanat compound (manufactured by Nippon polyurethane K.K., tradename, Coronate EH) | 20 parts |
| Toluene | 600 parts |
| Methyl ethyl ketone | 600 parts |

A coating solution having the above composition was applied in the same manner as in Example 1 to obtain an image receiving sheet.

Recording was conducted in the same manner as in Example 1, whereby the color density was as high as 1.93, and no fusion was observed between the ink layer and the image receiving layer. Further, the printed surface was inspected by a microscope, whereby no substantial trace of thermal deformation by the thermal head was observed.

Further, no color blotting of the record after the storage test was observed.

EXAMPLE 7

| | |
|---|---|
| Vinyl chloride/vinyl acetate/vinyl alchol copolymer resin (manufactured by Union Carbide Co., tradename: UCAR solution vinyl VAGH) | 100 parts |
| Modified silicone varnish (manufactured by Toshiba Silicone K.K., tradename: TSR-160) | 50 parts |
| Amino-modified silicone oil (manufactured by Shin-Etsu Chemical Co., Ltd., tradename: KF393) | 2.5 parts |
| Polyfunctional isocyanate compound (manufactured by Mitsubishi Kasei Corporation, tradename: Mytec GP-750A) | 15 parts |
| Toluene | 600 parts |
| Methyl ethyl ketone | 600 parts |

A coating solution having the above composition was applied in the same manner as in Example 1 to obtain an image receiving sheet.

Recording was conducted in the same manner as in Example 1, whereby the color density was as high as 1.82, and no fusion was observed between the ink layer and the image receiving layer. Further, the printed surface was inspected by a microscope, whereby no substantial trace of thermal deformation by the thermal head was observed.

Further, the above record was maintained for five days at 60° C. under a relative humidity of 60%. Then, the degree of the color blotting of the record was observed by a microscope, whereby no substantial blotting was observed.

COMPARATIVE EXAMPLE 3

An image receiving sheet was prepared in the same manner as in Example 7 except that no modified silicone varnish was used. Recording was conducted in the same manner as in Example 1, whereby the color density was as low as 1.30, although no fusion was observed between the ink layer and the image receiving layer, and no substantial trace of thermal deformation by the thermal head was observed by the microscopic inspection of the printed surface.

No substantial color blotting of the record after the storage test was observed.

COMPARATIVE EXAMPLE 4

An image receiving sheet was prepared in the same manner as in Example 7 except that no polyfunctional isocyanate compound was used. Recording was conducted in the same manner as in Example 1, whereby although the color density was as high as 1.80, slight fusion was observed between the ink layer and the image receiving layer, and a mark of thermal deformation by the thermal head was distinctly observed by the microscopic observation of the printed surface, and the gloss of the printed image portion was low.

No color blotting of the record after the storage test was observed.

EXAMPLE 8

| | |
|---|---|
| Vinyl chloride/vinyl acetate/ hydroxyl modified acryl copolymer resin (manufactured by Union Carbide Co., tradename: VAGF) | 100 parts |
| Silicone urethane varnish (manufactured by Toshiba Silicone K.K., tradename: TSR-175, solid content: 60 wt %) | 30 parts |
| Dicarboxy-modified silicone oil (manufactured by Shin-Etsu Chemical Co., Ltd., tradename: X-22-162C) | 1 part |
| Polyfunctional isocyanate compound (manufactured by Nippon Polyurethane Co., Ltd., tradename: Coronate HL) | 25 parts |
| Toluene | 600 parts |
| Methyl ethyl ketone | 600 parts |

A coating solution having the above composition was applied in the same manner as in Example 1 to obtain an image receiving sheet.

Recording was conducted in the same manner as in Example 1, whereby the color density was as high as 1.86, and no fusion was observed between the ink layer and the image receiving layer. Further, the printed surface was inspected by a microscope, whereby no substantial trace of thermal deformation by the thermal head was observed.

Further, no color blotting of the record after the storage test was observed.

COMPARATIVE EXAMPLE 5

An image receiving sheet was prepared in the same manner as in Example 8 except that the silicone urethane varnish was changed to dicarboxy-modified silicone oil (manufactured by Shin-Etsu Chemical Co., Ltd., X-22-162C). Recording was conducted in the same manner as in Example 1, whereby the color density was as high as 1.89, no fusion was observed between the ink layer and the image receiving layer, and no substantial trace of thermal deformation by the thermal head was observed in the microscopic inspection of the printed surface. However, when the record was maintained for five days at 60° C. under a relative humidity of 60%, color blotting was substantial, and the image blurred.

EXAMPLE 9

| | |
|---|---|
| Vinyl chloride/vinyl acetate maleic acid copolymer resin (manufactured by Union Carbide Co., tradename: VMCA) | 50 parts |
| Epoxy-modified vinyl chloride/vinyl acetate copolymer resin (manufactured by Union Carbide Co., tradename: VERR-40) | 50 parts |
| Silicone epoxy varnish (manufactured by Toshiba Silicone K.K., tradename: TSR-194) | 40 parts |
| Epoxy-modified silicone oil (manufactured by Shin-Etsu Chemical Co., Ltd., tradename: X-22 343) | 3 parts |
| Polyfunctional isocyanate compound (manufactured by Mitsubishi Kasei Corporation, tradename: Mytec NY-215Y) | 30 parts |
| Toluene | 600 parts |
| Methyl ethyl ketone | 600 parts |

A coating solution having the above composition was applied in the same manner as in Example 1 to obtain an image receiving sheet.

Recording was conducted in the same manner as in Example 1, whereby the color density was as high as 1.91, and no fusion was observed between the ink layer and the image receiving layer. Further, the printed surface was inspected by a microscope, whereby no substantial trace of thermal deformation by the thermal head was observed.

Further, no color blotting of the record after the storage test was observed.

EXAMPLE 10

| | |
|---|---|
| Polyvinyl phenyl acetal resin | 100 parts |
| Urethane modified silicone resin (varnish) manufactured by Toshiba Silicone K.K., tradename: TSR-175) | 30 parts |
| Dicarboxy-modified silicone oil (manufactured by Shin-Etsu Chemical Co., Ltd., tradename: X-22-162C) | 1 part |
| Polyfunctional isocyanate compound (manufactured by Nippon polyurethane Co., Ltd., tradename: Coronate HL) | 20 parts |
| Toluene | 600 parts |
| Methyl ethyl ketone | 600 parts |

A coating solution having the above composition was applied in the same manner as in Example 1 to obtain an image receiving sheet.

The above polyvinyl phenyl acetal resin was prepared by converting polyvinyl alcohol (saponification degree: 9 mol %, polymerization degree: 1700) to acetal by phenyl acetaldehyde and has the following structural formula:

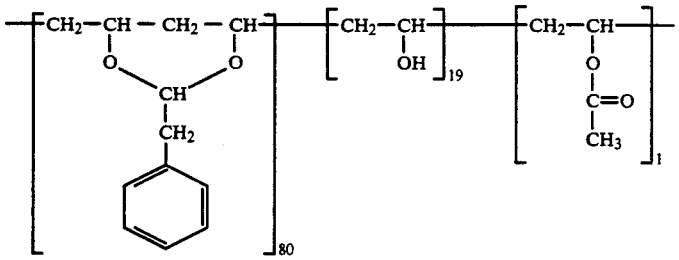

Recording was conducted in the same manner as in Example 1, whereby the color density was as high as 1.85, and no fusion was observed between the ink layer and the image receiving layer. Further, the printed surface was inspected by a microscope, whereby no substantial trace of thermal deformation by the thermal head was observed.

Further, no color blotting of the record after the storage test was observed.

COMPARATIVE EXAMPLE 6

An image receiving sheet was prepared in the same manner as in Example 10 except that the urethane-modified silicone resin (varnish) was changed to dicarboxy-modified silicone oil (manufactured by Shin-Etsu Chemical Co., Ltd., tradename: X-22-162C). Recording was conducted in the same manner as in Example 1, whereby the color density was as high as 1.83, no fusion was observed between the ink layer and the image receiving layer, and no substantial trace of thermal deformation by the thermal head was observed by the microscopic inspection of the printed surface. However, when the record was maintained for five days at 60° C. under a relative humidity of 60%, color blotting was substantial, and the image blurred.

EXAMPLE 11

| (a) Preparation of an image receiving sheet | |
|---|---|
| Polyvinyl phenyl acetal | 100 parts |
| Modified silicone resin (varnish) (manufactured by Toshiba Silicone K.K., tradename: TSR-160) | 40 parts |
| Amino modified silicone oil (manufactured by Shin-Etsu Chemical Co., Ltd., tradename: KF393) | 5 parts |
| Polyfunctional isocyanate compound (manufactured by Mitsubishi Kasei Corporation, tradename: Mytec NY-710A) | 15 parts |
| Toluene | 600 parts |
| Methyl ethyl ketone | 600 parts |

A coating solution having the above composition was coated on a polyethylene terephthalate (hereinafter referred to simply as PET) film having a thickness of 100 μm by a wire bar, followed by drying to obtain a coated layer having a dried layer thickness of about 5 μm. Then, heat treatment was conducted for 12 hours in an oven of 100° C. to obtain an image receiving sheet.

The above polyvinyl phenyl acetal resin was obtained in the same manner as in Example 10.

A color sheet was prepared in the same manner as in Example 1. The ink-coated side of the color sheet was overlaid on the image receiving sheet prepared in the above step (a), and recording was conducted under the following conditions using a thin film type line thermal head having a heat generating resister density of 8 dots/mm:

Recording line density: 8 lines/mm

Electric power applied to the thermal head: 0.2 W/dot

Width of pulses applied to the thermal head: 10 msec

The color density was as high as 1.95, and no fusion was observed between the ink layer and the image receiving layer. Further, the gloss of the printed surface was measured by a gloss meter, whereby gloss as high as 98 was observed.

Further, the above record was maintained for five days at 60° C. under a relative humidity of 60%. Then, the degree of color blotting of the record was examined by a microscope, whereby no substantial blotting was observed.

COMPARATIVE EXAMPLE 7

An image receiving sheet was prepared in the same manner as in Example 11 except that no modifying silicone resin was used. Recording was conducted in the same manner as in Example 1, whereby the color density was as low as 1.56, although no fusion was observed between the ink layer and the image receiving layer, and the gloss of the printed surface was as high as 105.

No substantial color blotting of the record after the storage test was observed.

COMPARATIVE EXAMPLE 8

An image receiving sheet was prepared in the same manner as in Example 11 except that no modifying silicone resin and no polyfunctional isocyanate compound were used. Recording was conducted in the same manner as in Example 11, whereby although the color density was as high as 1.96, slight fusion was observed between the ink layer and the image receiving layer, and the gloss of the printed surface was as low as 67, and no substantial gloss was observed.

No color blotting of the record after the storage test was observed.

EXAMPLE 12

| (a) Preparation of an image receiving sheet | |
|---|---|
| Polyvinyl phenyl acetal | 70 parts |
| Vinyl chloride/vinyl acetate/vinyl alcohol copolymer resin (manufactured by Sekisui Chemical Co., Ltd., tradename: Esrec A) | 30 parts |
| Modifying silicone varnish (manufactured by Toshiba Silicone K.K., tradename: TSR-160, solid content: 60 wt %) | 50 parts |
| Amino-modified silicone oil (manufactured by Shin-Etsu Chemical Co., Ltd., tradename: KF393) | 2.5 parts |
| Polyfunctional isocyanate compound | 15 parts |

-continued

| (a) Preparation of an image receiving sheet | |
|---|---|
| (manufactured by Mitsubishi Kasei Corporation, tradename: Mytec NY-710A) | |
| Toluene | 600 parts |
| Methyl ethyl ketone | 600 parts |

A coating solution having the above composition was applied in the same manner as in Example 1 to obtain an image receiving sheet.

The above polyvinyl phenyl acetal resin was obtained in the same manner as in Example 10.

(b) Preparation of a Color Sheet

On a biaxially stretched polyethylene terephthalate film (thickness: 6 μm) having the rear side of the ink-coating side treated for heat resistance and lubricating properties, an ink comprising 5 parts of a magenta sublimable dye of the foregoing formula (A), 10 parts of an AS resin (manufactured by Denki Kagaku Kogyo Kabushiki Kaisha, tradename: Denka AS-S), and 85 parts of toluene and 10 parts by cyclohexanone, was coated and dried to form an ink layer having a dried layer thickness of about 1 μm. Thus, a color sheet was prepared.

(c) Transfer Recording Test

The ink-coated surface of the above color sheet was overlaid on the image receiving sheet prepared in the above step (a), and recording was conducted under the following conditions using a thin film type line thermal head having a heat generating resister density of 8 dots/mm to obtain a record with a color density as shown in the following Table 1:

Recording line density: 8 lines/mm

Electric power applied to the thermal head: 0.4 W/dot

Width of pulses applied to the thermal head: 5 msec (d) The Surface Inspection and the Storage Stability Test of the Record The printed surface of the above record was inspected by a microscope, and the trace of thermal deformation was examined. The results are shown in following Table 1.

Further, the above record was exposed 80 hours by a xenone fade meter, and the degree of discoloration after the exposure was measured by a color difference meter. The results are shown in the-following Table 1.

Further, the above record was immersed in petroleum ether for one hour, and the remaining rate of the color density was measured. The results are shown in the following Table 1.

COMPARATIVE EXAMPLE 9

The image receiving sheet and the color sheet were prepared, and the tests were conducted in the same manner as in Example 12 except that in Example 12, instead of the vinyl chloride/vinyl acetate/vinyl alcohol copolymer resin, a polyvinyl phenyl acetal resin was used entirely. The results are shown in Table 1.

COMPARATIVE EXAMPLE 10

The image receiving sheet and the color sheet were prepared, and the tests were conducted in the same manner as in Example 12 except that in Example 12, no modifying silicone varnish was used. The results are shown in Table 1.

COMPARATIVE EXAMPLE 11

The image receiving sheet and the color sheet were prepared, and the tests were conducted in the same manner as in Example 12 except that in Example 12, no polyfunctional isocyanate compound was used. The results are shown in Table 1.

COMPARATIVE EXAMPLE 12

The image receiving sheet and the color sheet were prepared, and the tests were conducted in the same manner as in Example 12 except that-in Example 12, the modifying silicone varnish was changedto amino-modified silicone oil (manufactured by Shin-Etsu Chemical Co., Ltd., tradename: KF-393). The results are shown in Table 1.

EXAMPLE 13

| | |
|---|---|
| Polyvinyl benzal resin | 60 parts |
| Vinyl chloride/vinyl acetate/ hydroxyl-modified acryl copolymer resin (manufactured by Union Carbide Co., tradename: VAGF) | 40 parts |
| Silicone urethane varnish (manufactured by Toshiba Silicone K.K., tradename: TSR-175, solid content: 60 wt %) | 30 parts |
| Dihydroxy-modified silicone oil (manufactured by Shin Etsu Chemical Co., Ltd., tradename: X-22-160AS) | 1 part |
| Polyfunctional isocyanate compound (manufactured by Nippon Polyurethane Co., Ltd., tradename: Coronate HL) | 25 parts |
| Toluene | 600 parts |
| Methyl ethyl ketone | 600 parts |

A coating solution having the above composition was applied in the same manner as in Example 12 to obtain an image receiving sheet. Tests were conducted in the same manner as in Example 12, and the results are shown in Table 1.

The above polyvinyl benzal resin was obtained by converting polyvinyl alcohol (saponification degree: 98 mol %, polymerization degree: 2400) to acetal by benzaldehyde and has the following formula:

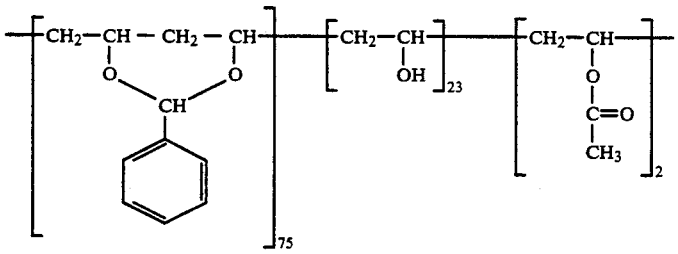

COMPARATIVE EXAMPLE 13

| | |
|---|---|
| Polyester resin (manufactured by Toyobo Co., Ltd., tradename: Viron 290) | 100 parts |
| Dicarboxy-modified silicone oil (manufactured by Shin-Etsu Chemical Co., Ltd., tradename: KF-393) | 5 parts |
| Toluene | 600 parts |
| Methyl ethyl ketone | 600 parts |

A coating solution having the above composition was applied in the same manner as in Example 12 to obtain an image receiving sheet. Tests were conducted in the same manner as in Example 12, and the results are shown in Table 1.

TABLE 1

| | Degree of thermal deformation (*) | Color density of the record | Degree of color blotting of the record | Discoloration of the record after exposure (ΔE) | Remaining rate of the color density after immersion in a solvent |
|---|---|---|---|---|---|
| Example 12 | ○ | 1.82 | Nil | 4 | 95% |
| Comparative Example 9 | ○ | 1.79 | Nil | 4 | 70% |
| Comparative Example 10 | ○ | 1.35 | Nil | 4 | 96% |
| Comparative Example 11 | x | 1.93 | Nil | 3 | 93% |
| Comparative Example 12 | ○ | 1.86 | Substantial | 4 | 85% |
| Example 13 | ○ | 1.80 | Nil | 5 | 97% |
| Comparative Example 13 | x | 1.90 | Slight | 37 | 98% |

*○ indicates that no substantial thermal deformation was observed, and x indicates that the degree of thermal deformation was substantial.

As described in the foregoing, when the product of the present invention is used as an image receiving sheet for thermal transfer recording, high density recording can be obtained, no fusion takes place between the ink layer and the image receiving layer, no substantial thermal deformation is observed on the surface of the image receiving layer after printing. Accordingly there will be little deterioration in the gloss of the image receiving layer surface during the high energy printing, and it is further possible to obtain a record having excellent stability of the image even under a high temperature high humidity condition, under exposure or under dipping in a solvent. The present invention is particularly effective when high energy printing is conducted by a thermal head for high speed recording, or printing is conducted by the current conducting system for high speed printing.

Thus, the present invention can be used advantageously for color recording of television images or for color recording by terminals of e.g. facsimile machines, printers or copying machines, use of which is rapidly expanding in recent years.

We claim:

1. An image receiving sheet for thermal transfer recording, which comprises a substrate and an image receiving layer formed thereon for receiving a sublimable dye, wherein the image receiving layer comprises, as the main component, a product formed by thermosetting a composition comprising an active hydrogen-containing resin, a silicone resin, a modified silicone oil and a polyfunctional isocyanate compound.

2. The image receiving sheet for thermal transfer recording according to claim 1, wherein the active hydrogen-containing resin is at least one resin selected from the group consisting of a polyvinyl acetal resin and a polyvinyl chloride resin.

3. The image receiving sheet for thermal transfer recording according to claim 1, wherein the active hydrogen-containing resin is a mixture of a polyvinyl acetal resin and a hydroxyl group-containing polyvinyl chloride resin.

4. The image receiving sheet for thermal transfer recording according to claim 3, wherein the weight ratio of the hydroxyl group-containing polyvinyl chloride resin is from 5 to 100 parts by weight to 100 parts by weight of the polyvinyl acetal resin.

5. The image receiving sheet for thermal transfer recording according to claim 1, wherein the modified silicone resin is selected from the group consisting of silicone resins which contain hydroxyl groups or methoxy groups as functional groups, urethane-modified silicone resin, epoxy-modified silicone resin, polyester-modified silicone resin, alkyd-modified silicone resin, acryl-modified silicone resin, melamine-modified silicone resin and phenol-modified silicone resin.

6. The image receiving sheet for thermal transfer recording according to claim 1, wherein the weight ratio of the modified silicone resin is from 10 to 400 parts by weight to 100 parts by weight of the active hydrogen-containing resin.

7. The image receiving sheet for thermal transfer recording according to claim 1, wherein the silicone oil has a functional group selected from the group consisting of an alcoholic hydroxyl group, a carboxyl group, an amino group, a mercapto group and an epoxy group.

8. The image receiving sheet for thermal transfer recording according to claim 1, wherein the weight ratio of the silicone oil is from 0.02 to 20 parts by weight to 100 parts by weight of the active hydrogen-containing resin.

9. The image receiving sheet for thermal transfer recording according to claim 1, wherein the polyfunctional isocyanate compound is selected from the group consisting of tolylene diisocyanate, xylylene diisocyanate, 4,4'-diphenylmethane diisocyanate, 1,5-naphthylene diisocyanate, 1,4-tetramethylene diisocyanate, 1,6-hexamethylene diisocyanate, isopropylidenecyclohexyl diisocyanate, and isophorone diisocyanate.

10. The image receiving sheet for thermal transfer recording according to claim 1, wherein the isocyanate equivalent of the polyfunctional isocyanate is from 0.1 to 3 relative to 1 equivalent of active hydrogen in the active hydrogen-containing resin.

11. The image receiving sheet for thermal transfer recording according to claim 1, wherein the active hydrogen-containing resin is at least one resin selected from the group consisting of a saturated polyester resin, a polyamide resin, and acryl resin, a cellulose acetate resin, a phenoxy resin, a polyurethane resin, an epoxy resin, a vinylchloride-vinylacetate-vinylalcohol copolymer resin and a polyvinyl acetal resin.

12. The image receiving sheet for thermal transfer recording according to claim 1, where the modified silicone resin is selected from the group consisting of silicone resins having hydroxyl groups and alkoxy groups.

13. The image receiving sheet for thermal transfer recording according to claim 1, wherein the modified silicone resin is selected from the group consisting of a urethane-modified silicone resin, an epoxy-modified silicone resin, a polyester-modified silicone resin, an alkyd-modified silicon resin, an acryl-modified silicone resin, a melamine-modified silicone resin and a phenol-modified silicone resin.

14. The image receiving sheet for thermal transfer recording according to claim 1, wherein the active hydrogen-containing resin is at least one resin selected from the group consisting of a saturated polyester resin, a polyamide resin, an acryl resin, a cellulose acetate resin, a phenoxy resin, a polyurethane resin, an epoxy resin and a polyvinylacetal resin.

15. The image receiving sheet for thermal transfer recording according to claim 14, wherein the modified silicone resin is selected from the group consisting of a urethane-modified silicone resin, a polyester-modified silicone resin, an acryl-modified silicone resin, a melamine-modified silicone resin and a phenol-modified silicone resin.

* * * * *